United States Patent [19]

Berkowitz

[11] 3,936,086

[45] Feb. 3, 1976

[54] INSIDE SAFETY RELEASE LATCH DEVICE

[75] Inventor: Irving L. Berkowitz, Binghamton, N.Y.

[73] Assignee: Kason Hardware Corporation, Binghamton, N.Y.

[22] Filed: July 22, 1974

[21] Appl. No.: 490,310

Related U.S. Application Data

[63] Continuation-in-part of Ser. No. 477,259, June 7, 1974.

[52] U.S. Cl. ..... 292/341.17; 292/DIG. 65

[51] Int. Cl.[2] ..... E05B 15/02

[58] Field of Search ..... 292/127, 227, 341.17, 100, 292/DIG. 65, DIG. 71

[56] References Cited

UNITED STATES PATENTS

| | | | |
|---|---|---|---|
| 1,147,322 | 7/1915 | Hampton | 292/227 X |
| 1,573,866 | 2/1926 | Rogers | 292/341.17 X |
| 1,937,978 | 12/1933 | Miller | 292/127 |
| 2,246,787 | 6/1941 | Dall | 292/227 X |
| 2,747,906 | 5/1956 | Emmert | 292/DIG. 65 X |
| 2,762,645 | 9/1956 | Bordner | 292/DIG. 65 X |
| 2,772,110 | 11/1956 | Petrochko | 292/341.17 |
| 2,849,250 | 8/1958 | Williamson | 292/341.17 X |
| 2,966,864 | 1/1965 | Weaver | 292/DIG. 65 X |
| 3,045,464 | 7/1962 | Braginetz | 292/341.17 X |
| 3,650,554 | 3/1972 | Tharp | 292/127 |

*Primary Examiner*—Roy D. Frazier
*Assistant Examiner*—Thomas J. Holko
*Attorney, Agent, or Firm*—Paul J. Sutton

[57] ABSTRACT

The present invention provides a safety striker mechanism available and accessible from within an enclosure that is normally locked by means of a door-mounted latch. A freezer or refrigerator door, for example, may be provided with a door latch which is capable of being locked with a key. The door latch cooperatively engages a safety striker mechanism according to the invention which may be independently actuated from within the enclosure such that the striker member is disengaged from contact with and out of the path of the associated latch member. The result is the ability of a person otherwise trapped within the enclosure to reach safety. A novel linkage-type of mechanism having a plurality of pivot points translates rectilinear actuating movement into an arcuate movement of the striker member.

16 Claims, 6 Drawing Figures

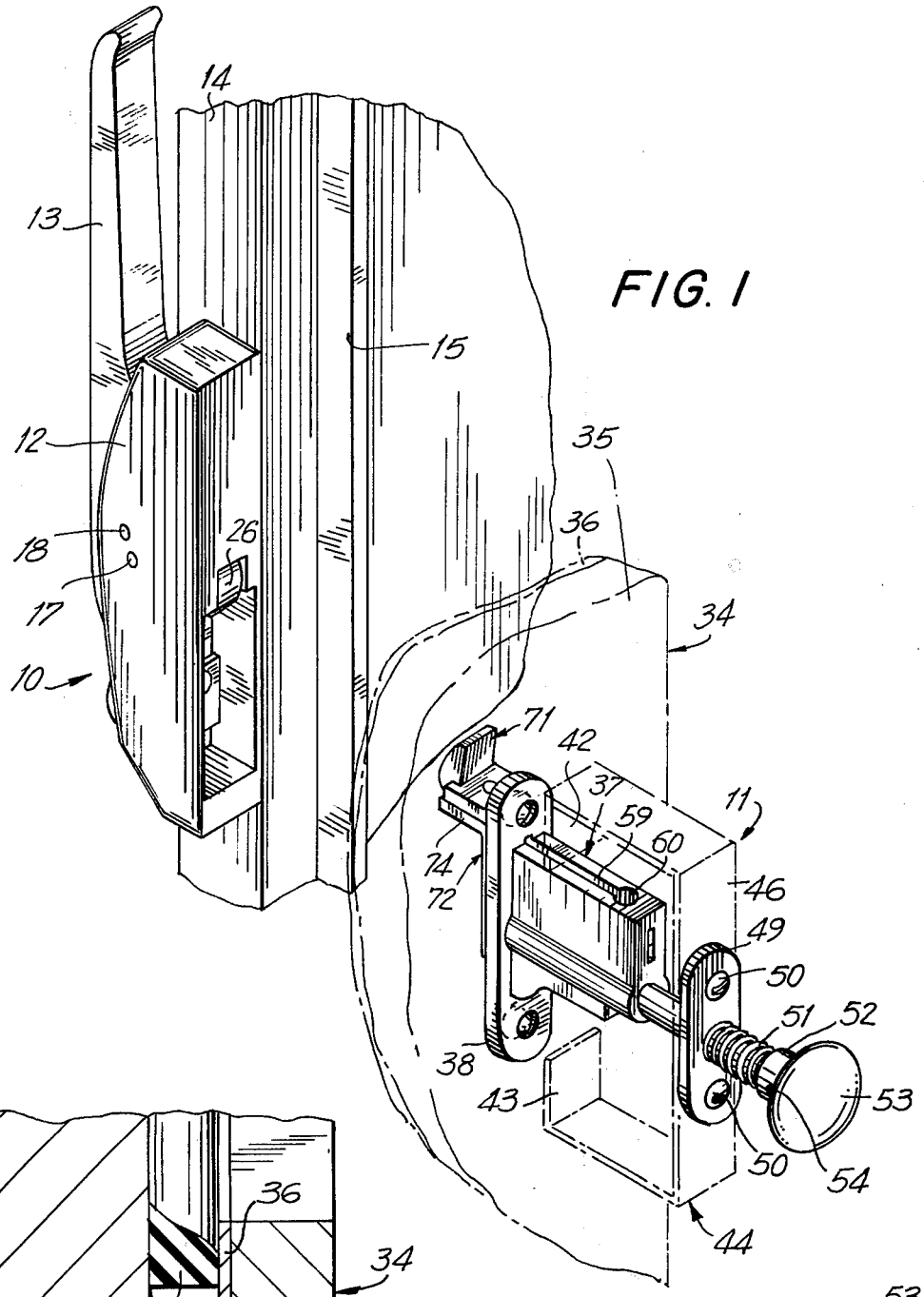
FIG. 1
FIG. 2
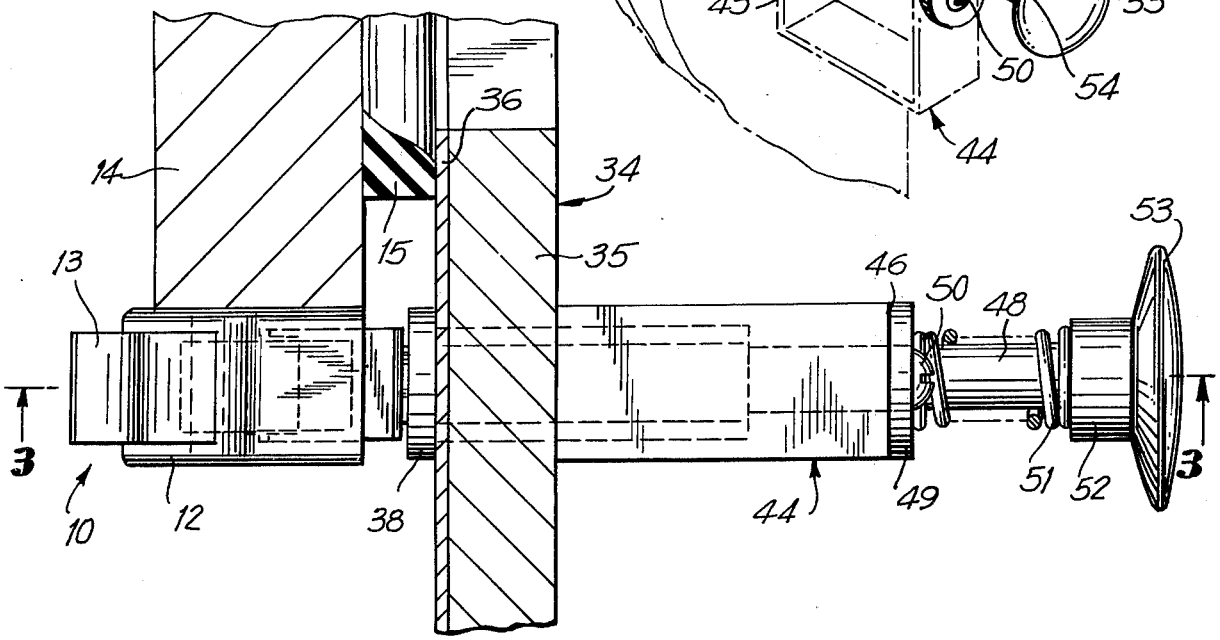

12
21
30
15
34
13
18
16
36
35
20
29
44
71
38
19
26
45
46
27
28
41
17
37
42
49
25
59
23
74
63
57
60
50
11
10
72
62
22
33
55
65
24
76
69
68
77
64
48
75
80
61
32
73
81
47
51
54
56
58
31
67
78
70
52
66
40
50
53
45
41
39
43
36
35

13
12
30
34
18
29
35
44
20
16
38
45
46
19
26
41
17
28
42
37
71
59
49
25
57
63
60
50
11
23
33
62
10
76
68
55
65
24
74
75
77
80
64
48
22
69
72
61
32
73
47
51
54
78
70
58
56
31
75
81
52
50
66
67
45
53
41
43
39
36
35

INSIDE SAFETY RELEASE LATCH DEVICE

This application is a continuation-in-part patent application of my copending application Ser. No. 477,259 filed June 7, 1974.

This invention relates generally to door latch and striker devices, and more particularly to an improved safety striker assembly for refrigerator and other doors which can be easily and conveniently mounted on a door jamb, such that persons caught inside the structure containing the door may simply and quickly open the door.

A number of persons every year are locked and trapped inside coldrooms, such as commercial freezers and refrigerators. Some die of the cold and many are terrorized by their inability to escape or manifest their presence inside the room. Many coldroom door latches may be locked by key, and since the very thick doors usually associated with coldrooms have a very high sound insulation, the risks of a locked-in person being unable to make his presence in a large coldroom known to others outside the coldroom is quite high.

On the other hand, there is often good reason for having a coldroom door latch that may be locked by key. Security and inventory-control measures often justify the use of locking means. There is, therefore, a growing need for a latch-striker cooperative assembly that possesses both primary features of being securely lockable as well as being safe. The latter feature is thought by many to be the paramount feature.

Many efforts to solve these problems have been made and are known to the art. A search of U.S. Patent Office records will reveal a host of prior art patents which specifically deal with mechanical means for preventing the entrapment of children in household and discarded refrigerators. Some, for example, utilize the child's weight to trigger a door-releasing device. Most are quite complicated, mechanically speaking, and their reliability leaves much to be desired.

Let us look now at certain prior art patents which, while not anticipatory of the present invention, disclose representative examples of previous or known efforts to solve some of the structural problems associated with the art embodying this invention. U.S. Pat. No. 3,346,288 to Cosentino discloses a safety lock device which provides for the opening of a lock from inside or outside of a locked structure. FIG. 3 of this patent illustrates a schematic representation of what is believed to be a rather unreliable linkage-type of mechanism. A lever 12 formed with a hooked end 18 extends into a door 82 such that hooked end 18 engages portion 92 of a latch element. This engagement between the lever and latch element is supposed to prevent the opening of door 82. However, from the drawing a question is raised as to the effectiveness of the very lock itself. In order to utilize the Cosentino apparatus from inside the chamber 44 with which this mechanism is used, lever 12 is pivoted by means of the linkage and in response to a depression of pedal 68 such that hooked portion 18 rises in an arcuate motion about the pivot point represented by a rivet 16 until the hooked end portion 18 biases the latch portion 92 against the force of a spring 95 until this latch is pivoted and held by means of the same spring in a position illustrated in FIG. 4. In other words, in order to escape from the enclosure 44 utilizing the Cosentino discosure, it is necessary to manipulate and work the inner latch mechanism associated with latch handle 96. A considerable amount of movement, relatively speaking, is required since it is necessary to move spring 95 off center such that it is biasing latch element 88 in a clockwise direction, as opposed to the normally locked counterclockwise direction. The counterclockwise direction is best illustrated in FIG. 3, while the clockwise biasing is best illustrated in FIG. 4.

U.S. Pat. No. 3,412,586 to Sterner similarly discloses a safety lock for coldrooms and the like wherein a rotatable keeper for use with a locking bolt is formed with a notch occupying a portion of the cross section of this keeper. During the normal locked position, this bolt 3 is shown in FIG. 3 of this patent to engage and interfere with the rectilinear retraction of keeper 9, which has a generally cylindrical shape. However, upon rotation of keeper 9 to a position illustrated in FIG. 7, for example, the bolt is forced to assume a position in which it bears against the unnotched part of the keeper in a configuration which will enable the opening of the door from inside the room closed by this door without the use of a key.

Again, as in the case of the Cosentino patent, the Sterner mechanism requires a manipulation of the latch mechanism - in this case the bolt against the normally downward biasing force of spring 4.

U.S. Pat. No. 2,772,110 to Petrochko discloses a safety striking plate for use with door locks and illustrates the use of a retractable bolt member normally seated within a socket of the keeper member to prevent the keeper from pivoting. FIG. 6 of the Petrochko patent illustrates the retracted bolt, but also illustrates the need for interfering pivotal movement of the keeper in order for the latch to move to an open position.

While I do not wish to minimize the inventiveness and efforts of the inventors associated with the aforesaid three prior art patents, and while these people may be attempting to solve a problem that is similar to one of the problems solved by the present invention, it is worth mentioning a couple of representative drawbacks of these mechanisms. Firstly, if we are to provide a person locked in a coldroom with a reliable and easy means of escape through a door which is locked by a locked latch assembly, it is imperative that the structure provided for this purpose be quite highly reliable and devoid of unnecessary interactions with the locked latch assembly itself. In all three of these patents the reader will see that it is necessary in one way or another to influence inner latch elements that are normally locked. None of these patents disclose means which bypass entirely the locked latch such that it is unnecessary to move or manipulate elements that have been set in locked positions. Not only does this manipulation that is required in these three patents necessitate forces capable of overcoming the biasing forces of springs in each case, but should for any reason the latch that is locked malfunction or freeze, the locked-in person is simply not provided with independent means of disengaging the latch from the striker. In this way, the extra forces normally or conventionally required to overcome the spring forces in the locked latch assembly are simply not required and the task of the locked-in person seeking to extricate himself is made quite a bit easier.

Accordingly, it is an object of the present invention to provide a safety striker mechanism that can be used with a variety of latch assemblies of the locking type, and which will provide a safe and rapid means of escape from an otherwise locked enclosure.

Another object of this invention is to provide a combination latch and striker assembly capable of performing the above-mentioned functions.

Yet another object of this invention is to provide a safety striker mechanism which may be disengaged from within its associated enclosure without influencing or moving the locking mechanism of its associated latch assembly.

A further object of this invention is to provide a safety striker mechanism capable of being manipulated from within an enclosure and which is independent of the latch assembly with which it is normally associated when the latter is locked.

Another object of this invention is to provide a safety striker mechanism which provides the user with the security associated with a locked latch and striker assembly combination, but which further provides the user with the aforementioned safety features.

Still another object of this invention is to provide a novel mechanism for use with a safety striker mechanism, and which is relatively simple in design, relatively economical to produce, and highly reliable under repeated use.

According to one aspect of the present invention, the novel means and steps which are employed to overcome the disadvantages of prior art solution associated with the problems sought to be overcome by this invention include a safety striker mechanism for use with enclosure door latches or the like. The door latches referred to may be of the type having a movable keeper latch member adapted to releasably engage and be captively held by a stationary striker member when in a locked condition. According to this invention, a safety striker mechanism employs a movable striker member formed with surfaces normally disposed in the path of and capable of holding said latch member when its associated door latch is in a locked condition. However, safey release means which may be actuated independently of said door latch and which are accessible from within an enclosure locked by said door latch, may urge said striker member out of the path of the latch member, thereby unlocking the door and permitting ingress to and egress from said enclosure without manipulating, moving or influencing the mechanism associated with the latch member.

My invention will be more clearly understood from the following description of a specific embodiment of the invention, together with the accompanying drawings, wherein similar reference characters denote similar elements throughout the several views, and in which:

FIG. 1 is a fragmentary perspective view shown in exploded form and which illustrates the interrelationship between the safety striker assembly according to this invention and its associated lockable latch assembly;

FIG. 2 is a fragmentary sectional elevational view of a portion of the strike assembly shown in FIG. 1;

Figure 3:
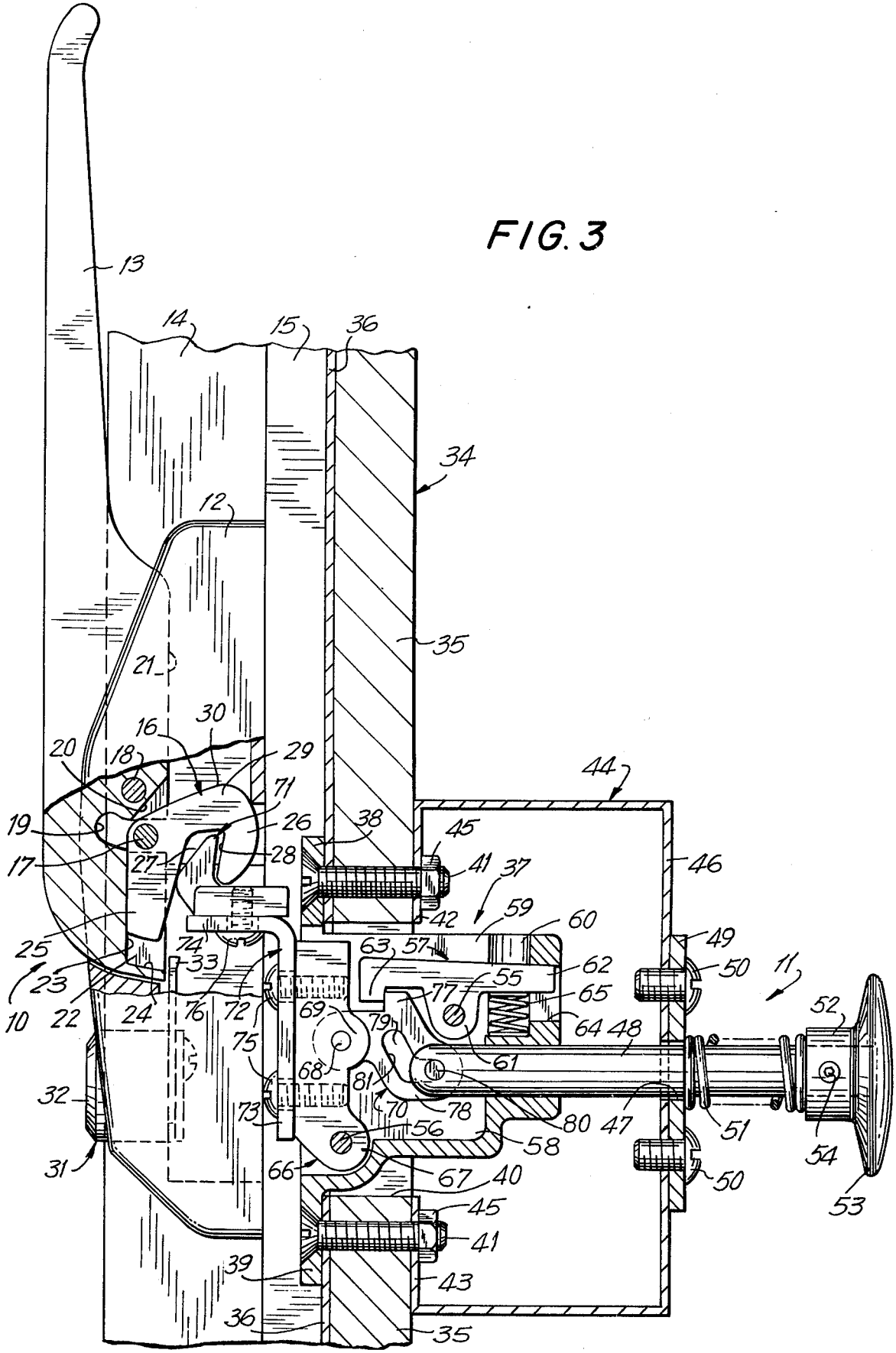
FIG. 3 is a fragmentary sectional elevational view looking along line 3—3 of FIG. 2, and illustrates the novel mechanism associated with the safety strike assembly of this invention.
Figure 4:
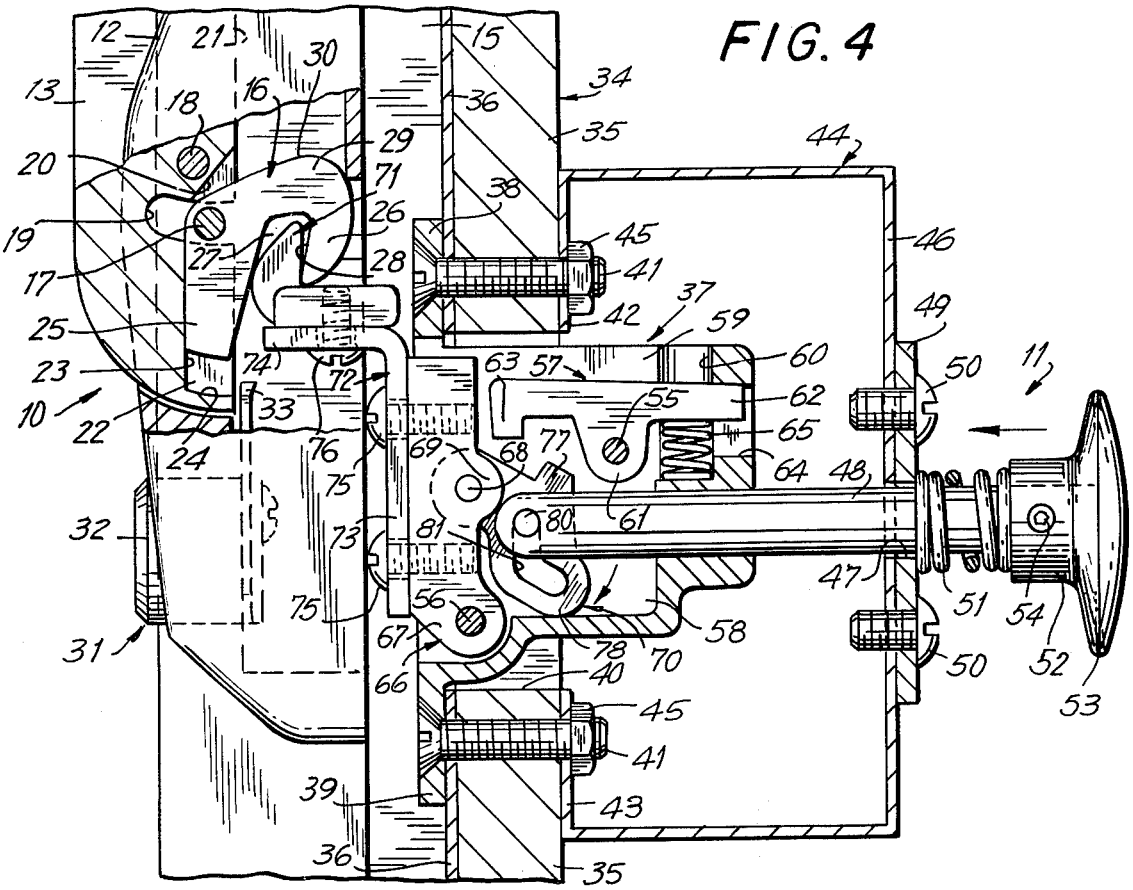
FIG. 4 is a fragmentary sectional elevational view similar to that of FIG. 3 but illustrating the interrelationships of moving parts of the mechanism according to this invention.
Figure 5:
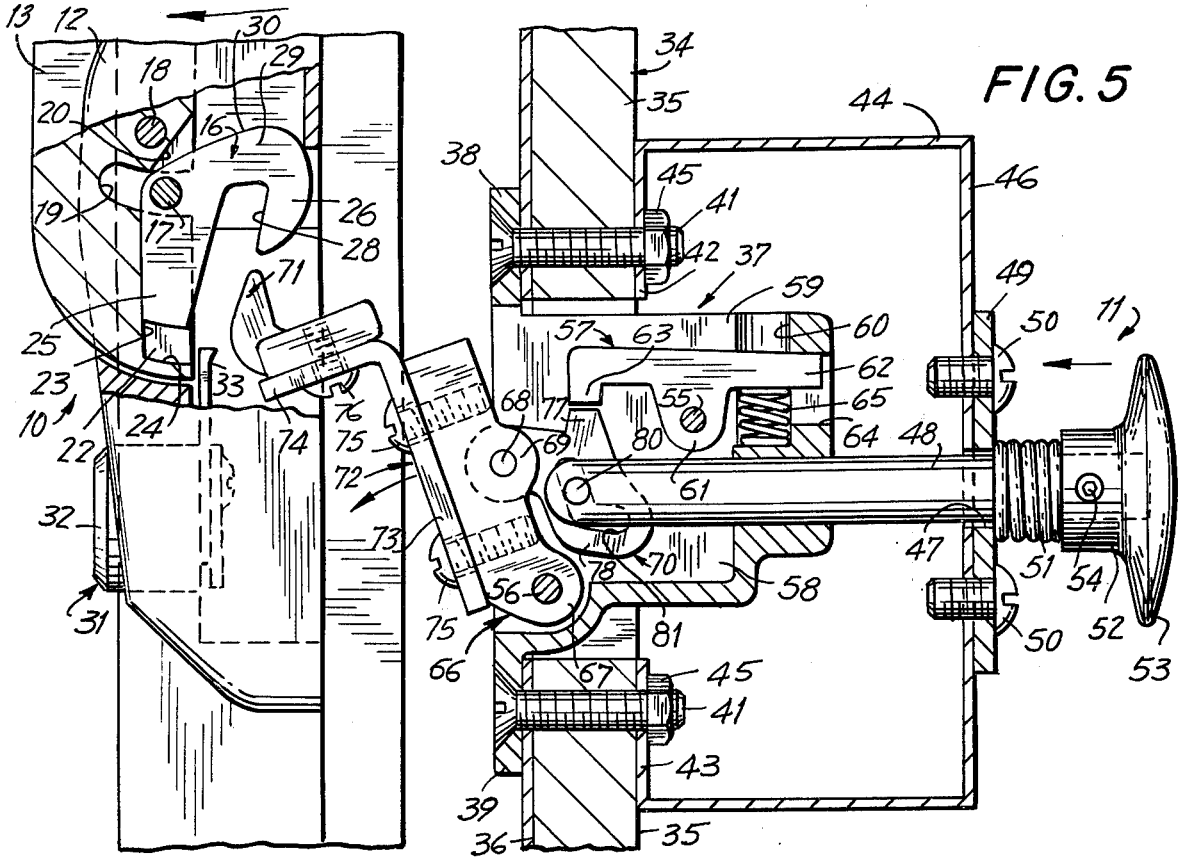
Figure 6:
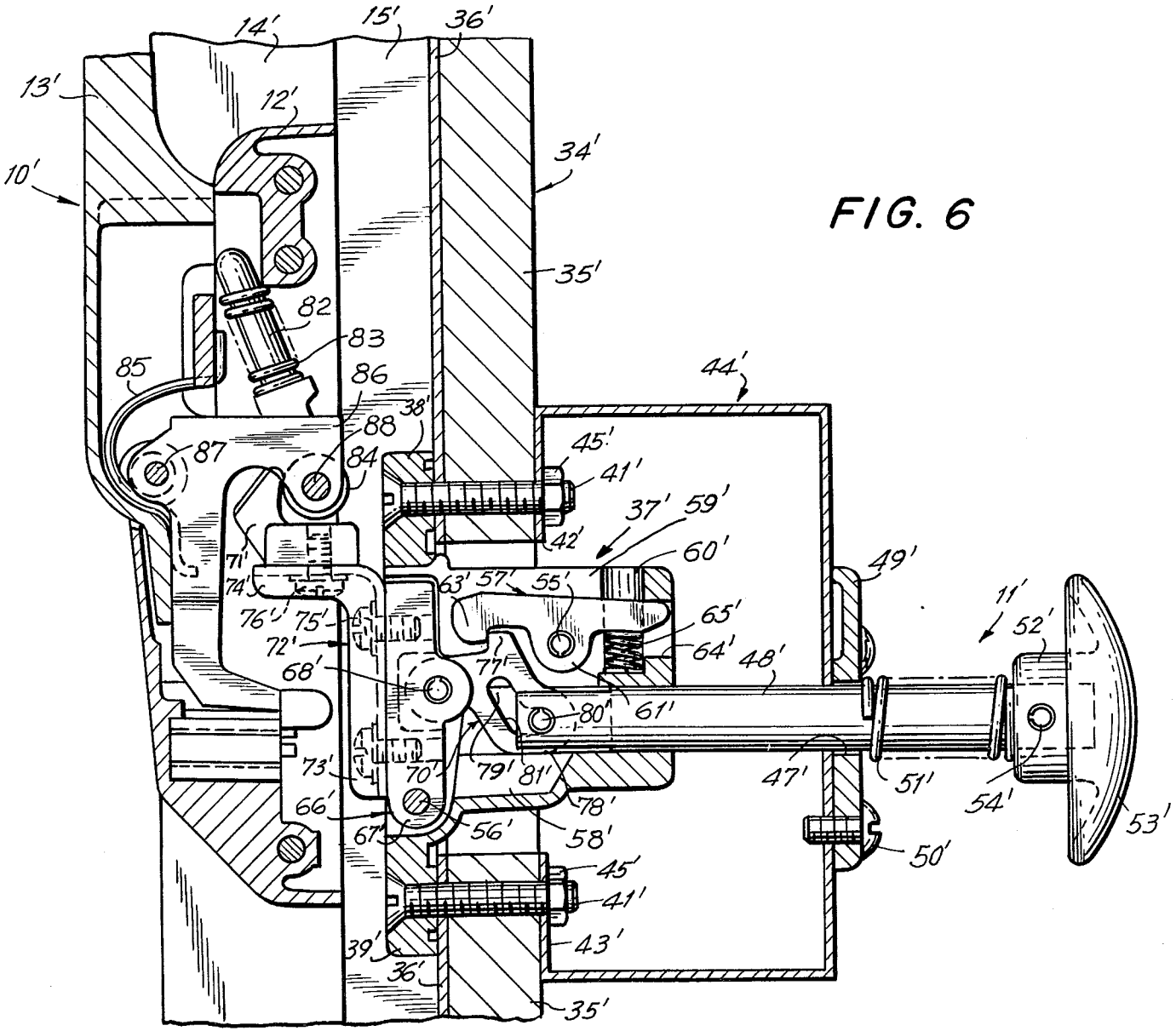

FIG. 5 is yet another fragmentary sectional elevational view similar to FIGS. 3 and 4 but further illustrating the safety strike assembly according to this invention in a position in which it is unlatched; and FIG. 6 is a fragmentary sectional elevational view similar to that depicted in FIG. 3, illustrating a preferred commercial embodiment of the present invention which utilizes a latch assembly having a roller tongue assembly.

Referring now in more detail to the drawings, it must be emphasized here that a number of terms and expressions used throughout this specification to designate elements and assemblies of elements of the present invention have been chosen merely as a matter of convenience for the reader. It must also be emphasized here that the latch and lock arts contain many expressions and terms which often delineate and describe the same element for a combination of elements. Therefore, I have chosen to designate by the term "latch" that portion of the overall door-locking assembly which is mounted on the door and is most easily recognized in FIG. 1 by its associated upstanding handle. The cooperative jambmounted assembly which forms a significant part of the present invention has been generally designated a "strike assembly" in order to clearly distinguish between the cooperative but structurally independent mechanisms.

In FIG. 1, a latch assembly 10 and a strike assembly 11 are shown in an exploded illustration spaced from one another. My use of the word "strike", as opposed the word "striker", to describe strike assembly 11 has been done without any intention of altering the conventional meaning of these somewhat synonymous words.

Latch assembly 10 is easily mounted on the edge of a door and, as shown in FIG. 1, may be mounted flush with the surface of the door to eliminate all hazards of protruding hardware. The body or housing 12 of latch assembly 10 is preferably made of high-pressure zinc die-casting, while the upstanding handle 13 is preferably brass. Highly polished chromium plating is preferably used as a finish on these parts, although the present invention contemplates using comparable and equivalent materials other than zinc and brass.

Latch assembly 10 is shown in FIG. 1 mounted upon the edge of a door 14 equipped with a gasket 15 of a conventional type. For purposes of illustration, door 14 will be described as the door of a coldroom or refrigerator of the type which may be entered by personnel. Since the coldroom, refrigerator or freezer with which the present invention may be used does not, itself, constitute a part of this invention, there has been no effort to specifically illustrate such an enclosure.

FIGS. 3, 4 and 5 further and perhaps better illustrate a portion of the inner mechanism of latch assembly 10. For example, a handle insert 16 is shown pivotally supported upon a pin 17 which, in turn, is supported by the walls of latch assembly housing 12. Handle 13 is mounted for pivotal movement in much the same manner upon pin 18 which, likewise, extends through the walls of latch assembly housing 10. Ends of pins 17 and 18 are illustrated as extending through housing 12 in FIG. 1.

A curved slot 19 formed in the base of latch assembly handle 13 accommodates pin 17 during times when handle 13 is pulled by the user to open the door. In a preferred embodiment of this invention, the walls of handle 13 defining the extremity of slot 19 may serve as a positive stop which limits this operational movement of handle 13 by coming into bearing contact with the surfaces of pin 17. Handle 13 is further formed with a chamfer or flat 20 above slot 19 which joins the edges of slot 19 with vertical wall 21 of handle 13. A recess 22 is defined by substantially vertical surface 23 and lower surface 24 of handle 13, this recess providing operational clearance for portions of handle insert 16, as will be more apparent from the description below. Of course, the outer surfaces and gripping portion of handle 13 are highly polished, smooth and have no sharp edges or burs that would interfere with the intended comfortable and relatively easy manipulation of this handle.

Handle insert 16 in this specification is shown as being of a friction-type catch, as opposed to a roller-type catch. This invention contemplates the use of any number of different types of handle shapes and handle insert types and shapes without departing from the scope and spirit of the invention. Handle insert or catch 16 includes a depending leg 25 which is integrally formed with a hooked portion 26 defining a recess 27 therebetween. The boundary of recess 27 farthest from pin 17 is defined by bearing surface 28 of hooked portion 26.

An intermediate portion 29 formed with an upper surface 30 joins depending leg 25 with hooked portion 26 to form an integral structure.

Handle insert 16 is capable of pivoting between two extreme positions, one of which is shown in FIG. 3, for example. From the position shown in FIG. 3, handle insert 16 is capable of pivoting clockwise about the axis of pin 17 to a position where upper surface 30 of intermediate portion 29 comes to bear against the surfaces of chamfer 20 of handle 13. Thus, when door 14 is closed by a person holding handle 13, the latching action afforded by handle insert 16 is capable of working independently of the handle itself such that the operator will not experience handle-jolt when he slams door 14 shut.

It has already been stated that the present invention contemplates utilizing a novel safety striker or strike assembly with any number of types of latch assemblies. For purposes of illlustration here, latch assembly 10 has been shown as being a type which possesses a cylinder lock assembly 31 which is capable of being locked and unlocked with a key (not shown). By inserting and turning a key within cylinder body 32 of lock assembly 31, the user is able to lock or prevent pivotal movement of handle 13 via the upward disposition of a locking plate 33, which is cooperatively supported by the cylinder body 32. In FIG. 3, for example, locking plate 33 is shown in its locked position whereby counterclockwise movement of handle 13 about the axis of pin 18 is interfered with by the presence of locking plate 33 in the path of the lowermost inner portions of the handle. If a user were to pull outwardly on handle 13, the lowermost portions of this handle would strike locking plate 33 and would thereby prevent the counterclockwise pivotal movement of handle insert 16 necessary to disengage same from the strike insert, which is described in detail below. Likewise, by turning the key in the opposite direction, locking plate 33 may be dropped such that a user on the outside of the enclosure closed by door 14 may gain access to the enclosure. It is important here to re-emphasize the fact that strike assembly 11 may be used with other types of lockable latch assemblies, such as those capable of accommodating a padlock, for example. In many such cases provision is made in or on the handle of the latch assembly for attaching a padlock.

Let us now turn our attention to strike assembly 11 which interacts with latch assembly 10 in the preferred embodiment being described herein. Strike assembly 11 may be mounted any number of ways such that it is supported by a relatively stationary door jamb, generally designated reference character 34 in the drawings. With varying types of coldroom or refrigerator structures, the structural makeup of the coldroom walls and/or door jambs will vary. This invention contemplates using strike assembly 11 in a manner in which it is mounted directly through the door jamb or coldroom wall, or, in the alternative, supported by a separate bracket structure in instances where that is either necessary or more desirable. Strike assembly 11 is of a type which may be used to replace existing strike assemblies which do not afford the safety features hereindescribed. Only for purposes of illustration, FIG. 3, for example, illustrates the jamb structure 34 as being a composite of insulating material 35 to which a metallic covering or face plate 36 is integrally secured. It is cover material 36 against which gasket 15 comes to rest to provide a reliable substantially air-tight seal.

Strike assembly 11 comprises a mechanism housing 37 formed with outwardly extending flanges 38 and 39 which, in turn, bear against the peripheral face portions of cover material 36 adjacent an opening 40 formed in door jamb 34. Opening 40 may be of any configuration which will accommodate the shape of strike assembly housing 37. Housing 37 is secured to door jamb 34 by means of flat-head bolts 41 which extend from countersunk openings in flanges 38 and 39 through cover material 36, thereafter through insulation material 35, through inwardly directed flanges 42 and 43 of bracket assembly 44, and finally into threaded engagement with their respective nuts 45. Bracket assembly 44 serves to support the rearward end of strike assembly 11 by providing at its rearward wall 46 an opening 47 therethrough which accommodates a rod 48 of the strike assembly. Mounting plate 49 is secured to rearward wall 46 by means of fasteners or bolts 50 which extend through the mounting plate 49 to threaded engagement with wall 46. Mounting plate 49 provides a bearing surface against which helical compression spring 51 comes to bear at one end thereof. At its opposite end, spring 51 bears against the hub 52 of knob 53 which, in turn, is secured by means of a rollpin 54 to rod 48. It is knob 53 that is utilized by a lock-in person to actuate the safety strike assembly 11, as will become more apparent from the following description.

Strike assembly housing 37 supports pins 55 and 56, which extend therethrough. Pin 55 may be a rollpin or other suitable solid configuration, while pin 56 is preferably a solid cylindrical member. A lever member 57 is mounted for pivotal movement upon pin 55 and is disposed within what can be described as an internal hollow 58 defined by the walls of housing 37. Hollow 58 terminates at its upper extremity in an elongated slot 59 formed with a generally cylindrical groove 60 at a rearward end thereof. Slot 59 and groove 60 enable the rather easy and inexpensive assembly of the strike assembly components located within hollow 58 during use.

Lever member 57 is generally elongated with a depending mounting hub 61 integrally secured to a tail portion 62 at one end thereof, and a depending finger 63 at its opposite end. Tail portion 62 extends into rearward hole 64 of housing 37 such that counterclockwise movement of lever member 57 is limited by the abutment of tail portion 62 against the upper surfaces of rearward hole 64. Lever member 57 is normally biased in a counterclockwise direction about the axis of pin 55 by means of helical compression spring 65. The vertical width of rearward hole or slot 64 is sufficiently large to enable noninterfering clockwise movement of tail portion 62 about the axis of pin 55.

A bar member 66 is formed with a mounting hub or boss 67 which is pivotally secured to pin 56, such that bar member 66 is free to pivotally rotate in limited amounts about the axis of pin 56. Approximately mid-length along bar member 66 and substantially vertically above pin 56. A roll pin 68 is secured to and extends between flanges 69 forming an integral part of bar member 66. Pin 68 provides the means of support for a link member 70 which, in turn, is pivotally supported at its forward end upon pin 68. Before describing link member 70 in a bit more detail, let us remain with bar member 66 so that its structure is clearly defined.

Bar member 66, along its other uses, provides the means of support of strike insert 71. It is strike insert 71 which coacts cooperatively with handle insert 16 to provide the locking arrangement between the latch assembly 10 and strike assembly 11. An L-shaped bracket 72 formed with a vertical leg 73 and a shorter horizontal leg 74 interconnects strike insert 71 and its basic supporting member, bar member 66. Elongated vertical leg 73 of bracket 72 is secured to bar member 66 by means of fasteners or bolts 75. By providing slotted openings through leg 73 to accommodate bolt 75, vertical adjustment of strike assembly 71 is facilitated. Similarly, a bolt 76 extends through a slotted hole formed in leg 74 of bracket 72 and into threaded engagement with strike insert 71, to provide vertical adjustability of the strike insert 71 with respect to strike assembly 11.

Looking now at link member 70, its shape and configuration is somewhat unique and critical to the novel interrelated movement between these various inner components housed within housing 37. Link member 70 includes an upstanding finger 77 which, when strike assembly 11 is in its non-actuated state, bears against finger 63 of lever member 57, thereby preventing movement of link member 70 to the left as viewed in FIG. 3. Link member 70 is further formed with an irregular body portion 78 which defines an elongated slot 79 therethrough. Slot 79 extends for a short distance in a horizontal direction and thereafter extends upwardly at an obtuse angle with respect to its substantially horizontal extension. A pin 80 which is secured to the forward end of rod 48 extends through the horizontal extension of slot 79 and is biased by means of helical compression spring 51 rearwardly against the extremity of this horizontal extension of slot 79.

Looking now at the cooperation and interraction between the several elements of safety strike assembly 11, it should first be noted that the interfering bearing action between finger 63 of lever member 57 and finger 77 of link member 70 normally prevents the counterclockwise rotation or pivotal movement of bar member 66 about the axis of pin 56. In this way, a positive locking is achieved between strike insert 71 and hook portion 26 of handle insert 16. In cases where cylinder lock assembly 31 is in a locked condition with locking plate 33 preventing the pivotal movement of handle 13 from being completed, a party outside door 14 is unable to gain access to the enclosure which is sealed by door 14. If this party pulls on handle 13 he will realize it is locked relatively immediately. In cases where cylinder lock assembly 31 is not locked, or is unlocked by the holder of a key compatible with this locking assembly, handle 13 may be pulled and rotated counterclockwise about the axis of pin 18 such that handle insert 16 will rotate about the axis of its pin 17 until hook portion 26 clears the normally stationary strike insert 71.

The descriptions of the operation of handle 13 and latch assembly 10 in the previous paragraph is of interest, but does not help a locked-in party who has been entrapped within the coldroom sealed by door 14. It should be emphasized here that the danger of entrapment of individuals or personnel within a coldroom or walk-in cooler has always been a concern of the industry. Such entrapments may occur accidentally, or may result from the malicious conduct of another party. Evidence of governmental concern about this issue can be found in the enactment of state safety laws which require safety latches for walk-in boxes. The state of California, for example, has enacted such laws. Other governmental agencies, such as the U.S. Army Quartermaster Division and the Veterans Administration expressly specify safety-type latches for their equipment.

According to the present invention, if we look at FIGS. 3, 4 and 5, it can be seen that an entrapped or locked-in party who cannot receive help from outside the coldroom locked by latch assembly 10 is able to push knob 53 against the compressive forces of helical spring 51 to the left, as shown in FIG. 3, or toward door 14. As knob 53 is pushed by the entrapped person, rod 48 and its pin 80 likewise move such that pin 80 rides forward in slot 79 toward bar member 66. During initial movement in this direction, pin 80 freely moves without engaging any interfering surfaces. However, once pin 80 has moved a sufficient distance to engage wall 81 which defines the leftmost boundary of slot 79, pin 80 is urged against wall 81 by the force of the entrapped party pushing upon knob 53. The result is an eccentric force applied on wall 81 and displaced an eccentric or offset distance below the axis of pin 68. A moment or pivotal force is thus created such that link member 70 pivots in a clockwise direction about the axis of pin 68 to a position better illustrated in FIG. 4. Of course, link member 70 need not be forced to this extreme position shown in FIG. 4 and may assume any number of noninterfering positions once same has been rotated about the axis of pin 68 to a point where fingers 63 and 77 are no longer in contact with one another.

Yet further pushing upon knob 53 during one complete stroke by the locked-in or entrapped party results in yet another moment or eccentric force. This second or additional moment which occurs subsequently to the moment or pivoting of link member about the exis of pin 68 comprises a force which is eccentric and above the axis of pin 56. More simply stated, pin 80 which is pushed against wall 81 of link member 70 now causes forces to be transmitted from wall 81, through link member 70 and into pin 68, such that a substantially horizontal force caused by the force transmitted through rod 48, and which is eccentric initially at a distance between the axes of pins 56 and 68, causes bar member 66 and the elements which bar members 66 carry, to pivot in a counterclockwise direction about the axis of pin 56. This counterclockwise pivoting of bar member 66 about the axis of pin 56 is facilitated by the initial pivoting of link member 70 out of interfering relationship with lever member 57. FIG. 5 illustrates the pivoting of bar member 66, bracket 72 and strike insert 71 in a counterclockwise direction about the axis of pin 56. It should be noted that strike insert 71 is actually pivoting out of the locked and interfering relationship with hook portion 26 of handle insert 16 during actuation and operation of safety strike assembly 11. Strike insert 71 simply bears against depending leg 25 and gently urges door 14 open to a position shown in FIG. 5, without requiring the otherwise counterclockwise pivoting of handle insert 16 about its pin 17. Thus, movement or manipulation of handle insert 16 and the components of cylinder lock assembly 31 are simply not at all required with the present invention, since the entrapped party's pushing upon knob 53 pivots strike insert 71 out of the otherwise interfering path of hook portion 26 of handle insert 16. There is, therefore, no need for bearing or interaction between strike insert 71 and the bearing surfaces 28 of hook portion 26.

I wish to emphasize here that the relative sizes and protruding links of fingers 63 and 77 are predetermined and may vary. Thus, the present invention contemplates the double pivoting action described above and illustrated in FIGS. 4 and 5 without the displacement of lever member 57 about the axis of its pin 55. In other cases which reflect a matter of mere choice of design, finger 77 of link member 70 may slightly engage the end of finger 63, such that lever member 57 is pivoted in a clockwise direction about the axis of pin 55 against the biasing compressive forces of spring 65. I wish to further emphasize here that the pivotal movement of lever member 57 just described is not at all necessary for the present invention to function according to its intended purposes. It may, for example, be desired to minimize the forces required on the part of the entrapped party against knob 53 and, in such cases, the less interference between the elements comprising safety strike assembly 11, the better.

Before concluding this specification, a number of comments are worth setting forth here. Firstly, the shapes and structural configurations of many of the elements of safety strike assembly 11 may be varied without departing from the spirit of this invention. Substitutions may be made in the structures used, and, as already emphasized, safety strike assembly 11 may be used with any one of a number of varieties of latch assemblies. For example, it is contemplated that safety strike assembly 11 be used with a latch assembly incorporating a roller catch, which will act smoothly and silently. In all cases, the cooperation between latch and strike assemblies 10 and 11, respectively, will provide relatively easy action for opening and closing doors. The latch is released from inside or outside with a minimum pressure or pulling. In all cases, the latch will provide a positive air-tight closure with each simple operation. Should the coldroom door become frosted, it is possible to utilize the handle of latch assembly 10 as a "frostbreaker", wherein the exertion of lever pressure against the striker will open the frozen door relatively easily. From a security standpoint, it is important to reemphasize that, notwithstanding the ability of an entrapped person to extricate himself from the closure sealed by door 14, the overall combination of latch and striker assemblies 10 and 11 provide a fool-proof, pilfer-proof mechanism. Thus, the latch cannot be jimmied open nor can the tongue be forced to release the latch.

The attention of the reader of this specification is now directed to FIG. 6 wherein latch and strike assemblies 10' and 11' are illustrated in a fragmentary sectional elevational view. For purposes of illustration, FIG. 6 has been added to the other drawings to illustrate the use of a preferred alternative commercial embodiment of a strike assembly 11' with a latch assembly 10' wherein a latch roller and tongue assembly combination is utilized. It should be noted that I have added a prime (') adjacent every element of strike assembly 11' which corresponds to the identical reference character previously described above for strike assembly 11. In this way the reader is not burdened with redundancy and it must be emphasized that the operation of strike assemblies 11 and 11' are substantially identical.

It has already been stated above that strike assembly 11, and also strike assembly 11', may be used with any number of different types of latch assemblies. It is, however, more desirable to utilize strike assemblies 11 and 11' with certain types of latch assemblies in order to achieve the most favorable and optimum results, even though the use of alternative types of latch assemblies will provide satisfactory and novel results.

In FIG. 6, I have utilized a prime (') adjacent each reference character corresponding to the reference characters of latch assembly 10. However, latch assembly 10' employs a tongue assembly 86 through which pins 87 and 88 extend. Pin 87 provides means for the pivotal support of tongue assembly 86 about the axis of pin 87. Pin 88 provides the rotary support of latch roller 84, which engages strike insert 71 or 71' during the locked condition of strike assembly 11'. Latch roller 84 functions in a manner equivalent and corresponding to handle insert 16 already described above for FIGS. 1–5.

The use of helical spring 83 supported upon spring support rod 82 facilitates the clockwise-biased pivotal rotation of tongue assembly 86 against the progressively increasing spring force of leaf-type spring 85.

Again, the operation of strike assembly 11' is substantially identical to the operation of strike assembly 11 and the entrapped or locked-in person within a coldroom will be able to extricate himself via the operation of these novel means.

The embodiment of the invention particularly disclosed and described hereinabove is presented merely as an example of the invention. Other embodiments, forms and modifications of the invention coming within the proper scope and spirit of the appended claims will, of course, readily suggest themselves to those skilled in the art.

What is claimed is:

1. A safety striker mechanism for use with enclosure door latches or the like of the type having a movable keeper latch member adapted to releasably engage and be captively held by a stationary striker member when in a locked condition, said safety striker mechanism comprising, in combination, a striker member having surfaces disposed in the path of and capable of holding a latch member associated with a door latch in a locked condition, and safety release means actuated independently of said door latch and accessible from within an enclosure locked by said door latch for urging said striker member out of the path of said latch member thereby unlocking said door and permitting ingress to and egress from said enclosure without substantially moving said latch member, said safety release means comprising a bar member supporting said striker member and itself supported for pivotal movement about a first axis, a link member supported by said bar member for pivotal movement about a second axis, a lever member cooperative with said link member and supported for pivotal movement about a third axis, and actuating means cooperative with said link member for first causing pivotal movement thereof about said second axis and only thereafter causing pivotal movement of the combination of said link member, said bar member and said striker member about said first axis, said lever member preventing said pivotal movement of said striker member during normal times when said actuating means is in a locked position, said lever member engaging and preventing pivotal movement of said link member about said first axis during said normal times.

2. A safety striker mechanism according to claim 1, wherein said safety release means is inaccessible from without said enclosure.

3. A safety striker mechanism according to claim 1, wherein said actuating means includes an elongated rod supported for substantially rectilinear reciprocatory movement between locked and unlocked positions, said pivotally supported bar and link members providing means for translating said rectilinear movement of the rod into arcuate movement of said striker member.

4. A safety striker mechanism according to claim 3, wherein said link member is formed with a non-axial slot, said acuating means further including a pin member carried by said rod and movably disposed within said slot, whereby movement of said rod toward said unlocked position from said locked position will cause said pin to bear against link member surfaces defining said slot, thereby positively causing pivotal movements of said link and bar members, respectively.

5. A safety striker mechanism according to claim 4, wherein said link member is further formed with a sloped bearing surface adapted to engage said lever member during movement of said rod from said unlocked position, thereby urging said lever member about said third axis against the biasing force of its associated spring to permit said link member to return to a restrained position occupied by it during said normal times.

6. A safety striker mechanism according to claim 1, wherein said lever member is spring biased toward said link member about said third axis.

7. A safety striker mechanism according to claim 1, wherein said actuating means rod is spring biased toward said locked position along an axis spaced eccentrically from both said first and second axes.

8. A safety method of unlocking a door to an enclosure from within the enclosure, said door carrying a door latch having a movable keeper latch member adapted to releasably engage and be captively held by a stationary striker member when in a locked condition, the method comprising the steps of: urging a safety striker mechanism actuating member substantially rectilinearly from a locked position to an unlocked position, translating said rectilinear movement of said actuating member into arcuate movement of a link member which is normally engaged and restrained by a lever member about a second axis, said lever member normally preventing said arcuate link member movement during times when said actuating member is in said locked position, said step of translating further causing movement of said link member out of said engagement with said lever member, further and subsequently pivotally moving said link member, said bar member and a striker member integral with said bar member about an axis, said step of further and subsequent movement causing movement of said striker member out of the path of a door latch member, thereby unlocking a door carrying the latch and permitting ingress to and egress from an enclosure normally closed by said door without substantially moving said latch member.

9. A safety striker mechanism for use with latches or the like of the type having a movable keeper latch member adapted to releasably engage and be captively held by a striker member, said safety striker mechanism comprising, in combination: a striker member having surfaces disposed in the path of a latch member and being capable of holding said latch member, a bar portion integral with said striker member and supported for pivotal movement about a first axis, actuating means cooperative with said bar portion and movable by a user between locked and unlocked positions for causing movement of said striker member out of said path of said latch member, link means carried by said bar portion and supported thereby for pivotal movement about a second axis for interconnecting said actuating means and said bar portions, and lever means cooperative with said link means for preventing pivotal movement of said link means about said second axis during times when said actuating means is disposed in said locked position.

10. A safety striker mechanism according to claim 9, wherein said actuating means is inaccessible from without an enclosure normally locked by cooperation between said striker member and said latch member, said actuating means being accessible to a party within the enclosure seeking egress.

11. A safety striker mechanism according to claim 9, wherein movement of said actuating means from said locked position to said unlocked position first causes pivotal movement of said link means about said second axis and thereafter causes pivotal movement of the combination of said link means and said bar portion about said first axis.

12. A safety striker mechanism according to claim 9, wherein said actuating means includes an elongated rod supported for substantially rectilinear reciprocatory movement between locked and unlocked positions, said pivotally supported bar portion and link means providing means for translating said rectilinear movement of the rod into arcuate movement of said striker member.

13. A safety striker mechanism according to claim 9, wherein said lever means comprises a lever member which is springbiased toward said link means about a third axis.

14. A safety striker mechanism according to claim 13, wherein said actuating means comprises an actuating member which is spring-biased toward said locked position along an axis spaced eccentrically from both said first and second axes.

15. A safety striker mechanism according to claim 9, wherein said link means comprises a link member formed with a non-axial slot, said actuating means including a pin member carried by an actuating member, said pin member being movably disposed within said slot, whereby movement of said actuating member toward said unlocked position from said locked position will cause said pin to bear against link member surfaces defining said slot, thereby positively causing pivotal movements of said link member and said bar portion, respectively.

16. A safety striker mechansim according to claim 15, wherein said link member is further formed with a sloped bearing surface adapted to engage said lever means during movement of said actuating means from said unlocked position, thereby urging said lever means about a third axis against the biasing force of spring means associated with said lever means to permit said link member to return to a restrained position occupied by it during normal times.

* * * * *